US007966770B1

(12) United States Patent
Kunz

(10) Patent No.: US 7,966,770 B1
(45) Date of Patent: Jun. 28, 2011

(54) ROUNDED SHOE AND POSITION BRAKE ASSEMBLY FOR THE COUNTERBALANCE SYSTEM OF A TILT-IN WINDOW

(76) Inventor: John R. Kunz, Douglassville, PA (US)

( * ) Notice: Subject to any disclaimer, the term of this patent is extended or adjusted under 35 U.S.C. 154(b) by 1219 days.

(21) Appl. No.: 11/072,122

(22) Filed: Mar. 7, 2005

(51) Int. Cl.
*E05D 15/22* (2006.01)

(52) U.S. Cl. ..... 49/181; 49/176; 49/445

(58) Field of Classification Search ..... 49/445, 49/176, 181; 16/193, 197
See application file for complete search history.

(56) References Cited

U.S. PATENT DOCUMENTS

| | | | | | |
|---|---|---|---|---|---|
| 1,097,524 | A * | 5/1914 | Brownjohn | ..... | 49/150 |
| 2,778,068 | A * | 1/1957 | Kaufman et al. | ..... | 49/181 |
| 3,055,063 | A * | 9/1962 | Peters | ..... | 49/174 |
| 3,462,882 | A * | 8/1969 | Brown, Jr. | ..... | 49/181 |
| 4,227,345 | A * | 10/1980 | Durham, Jr. | ..... | 49/181 |
| 4,718,194 | A * | 1/1988 | FitzGibbon et al. | ..... | 49/181 |
| 5,353,548 | A | 10/1994 | Westfall | ..... | 49/446 |
| 5,463,793 | A | 11/1995 | Westfall | ..... | 16/197 |
| 6,032,417 | A * | 3/2000 | Jakus et al. | ..... | 49/181 |
| 6,119,398 | A * | 9/2000 | Yates, Jr. | ..... | 49/181 |
| 6,378,169 | B1 | 4/2002 | Batten et al. | ..... | 16/197 |
| 2004/0006845 | A1 * | 1/2004 | Polowinczak et al. | ..... | 16/197 |

* cited by examiner

*Primary Examiner* — Gregory J. Strimbu
(74) *Attorney, Agent, or Firm* — LaMorte & Associates, P.C.

(57) ABSTRACT

A counterbalance assembly for counterbalancing a tilt-in window sash within a guide track of a window frame. A brake shoe housing is provided having a face section and a rear section defined between a top edge, a bottom edge, and two side edges. At least one of the two side edges is a curved surface having a convex curvature. A curl spring is provided having a free end. The free end of the curl spring engages the brake shoe housing, therein applying a turning torque to the brake shoe housing that cocks the brake shoe housing and moves the curved surface into tangential contact with the guide track. A cam actuator is interposed between the face section and the rear section that spreads these sections into contact with the guide track when the tilt-in window sash is tilted forward.

11 Claims, 7 Drawing Sheets

ROUNDED SHOE AND POSITION BRAKE ASSEMBLY FOR THE COUNTERBALANCE SYSTEM OF A TILT-IN WINDOW

BACKGROUND OF THE INVENTION

1. Field of the Invention

In general, the present invention relates to counterbalance systems for windows that prevent open window sashes from moving under the force of their own weight. More particularly, the present invention system relates to the brake shoe component of the counterbalance systems for tilt-in windows.

2. Description of the Prior Art

There are many types and styles of windows. One of the most common types of window is the double-hung window. Double-hung windows are the window of choice for most home construction. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make the window sash and the size of the window sash. Since the sashes of a double-hung window are free to move up and down within the frame of a window, some counterbalancing system must be used to prevent the window sashes from always moving to the bottom of the window frame under the force of their own weight.

For many years counterbalance weights were hung next to the window frame in weight wells. The weights were attached to the window sash using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

In prior art counterbalance systems, the shoes serve more than one purpose. The shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Second, the shoes engage curl springs. Curl springs are constant force coil springs that supply the counterbalance force to the weight of the window sash.

Single curl springs are used on windows with light sashes. Multiple curl springs are used on windows with heavy sashes. The curl springs provide the counterbalance force to the window sashes needed to maintain the sashes in place. The counterbalance force of the curl springs is transferred to the window sashes through the structure of the shoes and the tilt posts that extend from the window sash into the shoes.

Prior art shoes that contain braking mechanisms and engage counterbalance curl springs are exemplified by U.S. Pat. No. 6,378,169 to Batten, entitled Mounting Arrangement For Constant Force Spring Balance; U.S. Pat. No. 5,463,793 to Westfall, entitled Sash Shoe System For Curl Spring Window Balance; and U.S. Pat. No. 5,353,548 to Westfall, entitled Curl Spring Shoe Based Window Balance System.

Prior art shoes for curl spring counterbalance systems are typically complex assemblies. The shoes must contain a brake mechanism strong enough to lock a sash in place. Furthermore, the shoes must engage at least one strong curl spring. In modern tilt-in window construction, curl springs are made from flat bands of spring steel that are rolled into tight coils. The ends of the curl springs typically attach to the brake shoes at an off-center point. As a result, although the curl springs bias the brake shoes upwardly in the window frame track, the curl springs also apply a torque force to the brake shoes. The torque force tends to cock or rotate the brake shoe within the window track. The shoe binds in the guide track and the window becomes so difficult to open and close that it can not be considered functional. This cocked orientation also causes the brake shoe to wear against the window track in an uneven manner. Over time, it often becomes more difficult for the oddly worn shoes to move up and down.

A need therefore exists in the field of vinyl, tilt-in, double-hung windows, for a counterbalance system that eliminates the uneven wear of brake shoes caused by the spring torque. A need also exists in the field of vinyl, tilt-in double-hung windows for a counterbalance system that provides inexpensive, easily installed brake shoes that are highly reliable. These needs are met by the present invention as described and claimed below.

SUMMARY OF THE INVENTION

The present invention is a brake shoe assembly used within a counterbalance system for a tilt-in window. The brake shoe assemblies ride in guide tracks within the frame of the window along the sides of the window sashes. Tilt posts extend from the sashes into the brake shoe assemblies, wherein the brake shoe assemblies guide the movement of the tilt posts up and down in the guide tracks.

The brake shoe assemblies have housings with opposing face sections and rear sections that are disposed within a periphery of a first side edge, a second side edge, a top edge and a bottom edge. At least the first side edge of the brake shoe housing has a convex curvature that causes the brake shoe housing to contact the guide track at a tangent along that curved edge. The tangential contact minimizes wear and prevents the brake shoe housing from binding even when slightly cocked.

The brake shoe assemblies also contain an internal brake mechanism that acts to spread the face section of the brake shoe housing from the rear section along at least one edge when the sash of the window is tilted. As the brake shoe housing is spread apart, it interferes with the guide track and becomes locked in place until the window sash is tilted upright to its operational position.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
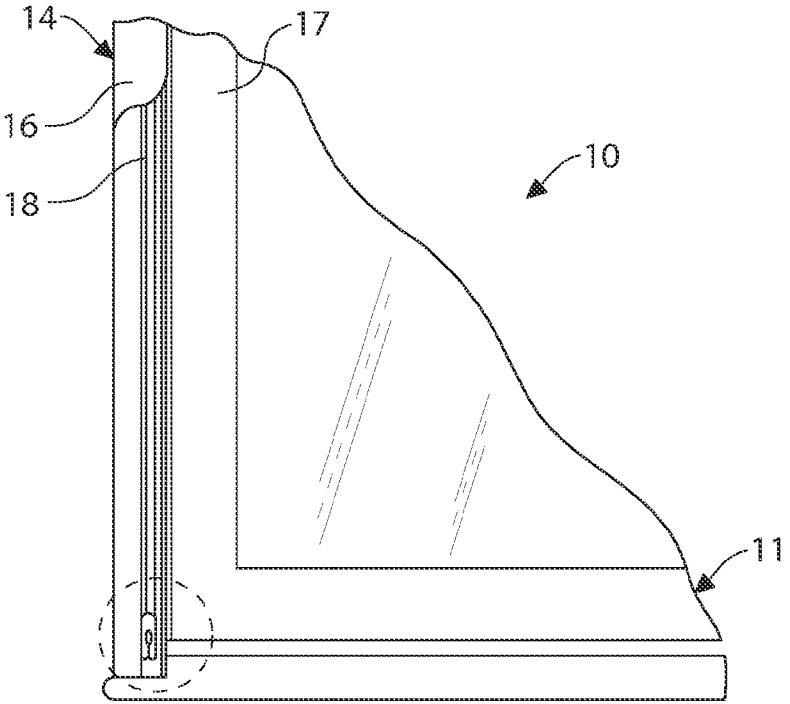
FIG. 1 is a partially fragmented view of a tilt-in window assembly containing a counterbalance system in accordance with the present invention.

Referring to FIG. 1, there is shown an exemplary embodiment of a vinyl, tilt-in, double-hung window assembly 10. The window assembly 10 has two sashes 11, which include an upper sash and a lower sash. Each of the sashes 11 has two side elements 17. The sashes 11 are contained within a window frame 14. The window frame 14 has two vertical sides 16 that extend along the side elements 17 of both sashes 11. Within each of the vertical sides 16 of the window frame 14 is formed a guide track 18.

Figure 2:
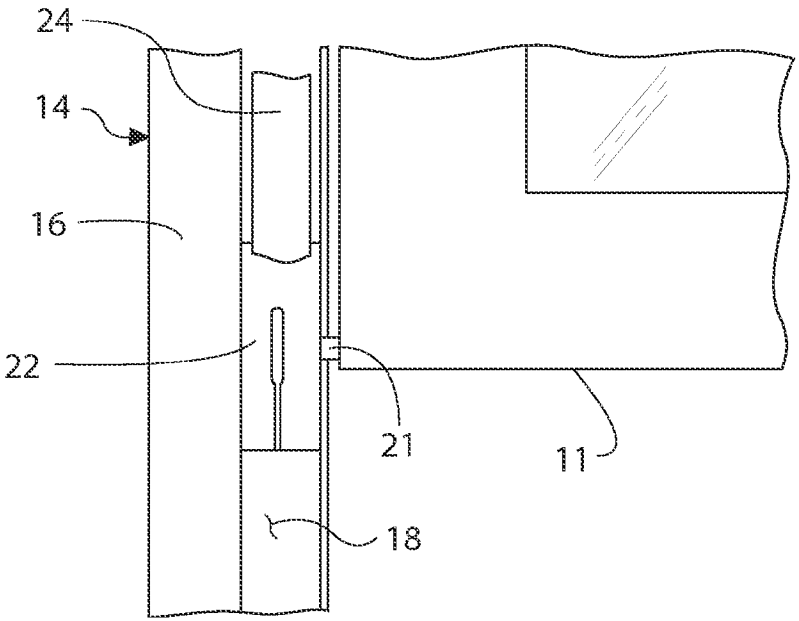
FIG. 2 is an enlarged view of the area of the brake shoe assembly contained within FIG. 1.

Referring to FIG. 2, it can be seen that the sash 11 has a tilt post 21 that extends out away from the side of the sash 11 and into the guide tracks 18 in the vertical sides 16 of the window frame 14. As is later explained in greater detail, a brake shoe assembly 22 is provided that attaches to the tilt post 21. The brake shoe assembly 22 serves two purposes. First, the brake shoe assembly 22 serves as a brake mechanism that locks the bottom of a sash 11 in place within the guide track 18 when a sash 11 is tilted inwardly. Second, the brake shoe assembly 22 serves as a point of attachment for a curl spring 24.

The curl spring 24 rotates and unwinds from a hub that is anchored high in the guide track 18. The free end of the curl spring 24 is affixed to the brake shoe assembly 22. Accordingly, the curl spring 24 applies an upward counterbalance force to each sash 11 that counteracts the weight of each sash 11.

Figure 3:
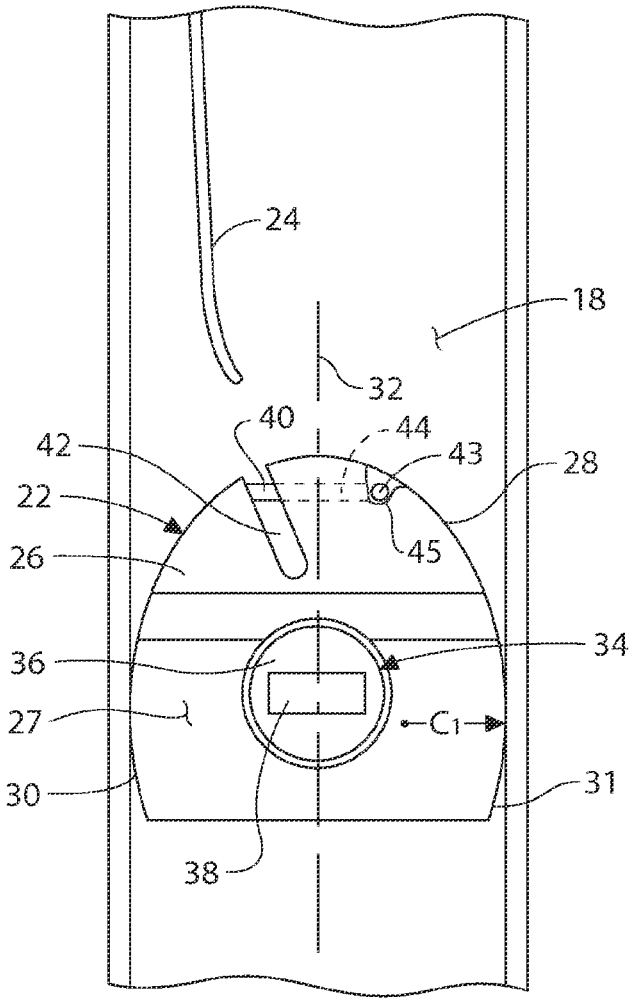
FIG. 3 is a side view of an exemplary embodiment of a brake shoe assembly in a guide track.

Referring to FIG. 3, it can be seen that the brake shoe assembly 22 has a uniquely shaped housing 26. The brake shoe housing 26 has a face surface 27 and a opposite rear surface (not shown) that are disposed between a top edge 28, a bottom edge 29 and two side edges 30, 31. As the brake shoe assembly 22 moves up and down within the window frame guide track 18, the side edges 30, 31 of the housing 26 ride within the confines of the guide track 18.

The side edges 30, 31 of the brake shoe housing 26 have a convex curvature. The convex curvature can be elliptical. However, it is preferred that the side edges have a first radius of curvature C1, which is preferably between three and twelve inches. The curved side edges 30, 31 of the brake shoe housing 26 progress into a common curved top edge 28. The curved top edge 28 has a tighter second radius of curvature that is between $3/8^{th}$ of an inch and one inch, depending upon the size of the window frame guide track 18. The maximum diameter of the curved top edge 28 should be just slightly smaller than the width of the interior of the window frame guide track 18.

The brake shoe housing 26 is shown with an imaginary centerline 32 extending down the center of the brake shoe housing 26 between the curved side edges 30, 31. Thus, the curved side edges 30, 31 are symmetrically disposed on either side of the imaginary centerline 32. For the purposes of this specification, the brake shoe housing 26 is considered to be in a "straight" orientation when the imaginary centerline 32 is vertical. A brake mechanism 34 is contained within the brake shoe housing 26. The brake mechanism 34 includes a cam actuator 36. The cam actuator 36 rotates within the brake shoe housing 26, as will later be explained. A portion of the cam actuator 36 extends through an access hole in the face surface 27 of the brake shoe housing 26. A recess 38 is formed within the exposed portion of the cam actuator 36. The recess 38 receives the horizontal tilt post 21 (FIG. 2) that extends from the window sash, Consequently, when the window sash is tilted, the cam actuator 36 is caused to turn within the brake shoe housing 26.

At least one attachment slot 42 is formed in the brake shoe housing 26 through the curved top edge 28. The attachment slot 42 receives the free end of a curl spring 24. A locking pin 40 is also provided. The locking pin 40 passes through a lateral hole 44 that communicates with the attachment slot 42 and locks the free end of the curl spring 24 into place. The locking pin 40 has a bent head 43 that can be selectively seated within a depression 45 with a snap-together fit. Thus, once in place, the locking pin 40 itself can be locked into place so it does not move and inadvertently disengage the curl spring 24.

Figure 4:
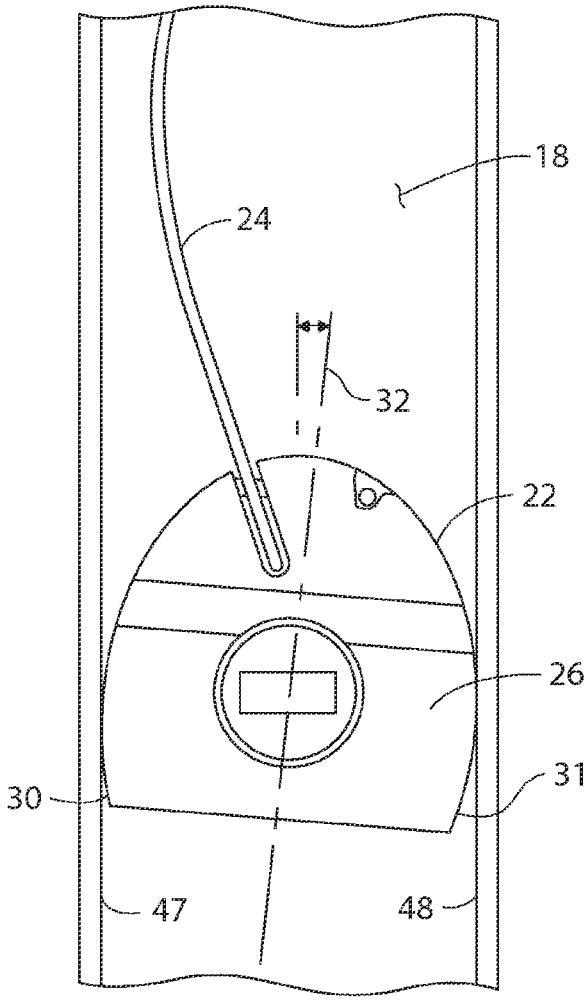
FIG. 4 is the same view as FIG. 3, with the brake shoe assembly being shown cocked by a curl spring.

Referring to FIG. 4, it can be seen that when the brake shoe assembly 22 is placed within a guide track 18 of a window frame, the curl spring 24 applies a turning torque to the brake shoe assembly 22. The torque causes the brake shoe assembly 22 to cock slightly within the confines of the guide track 18. As a consequence, the imaginary centerline 32 of the brake shoe housing 26 is turned away from its initial vertical orientation. The angle of the tilt is only a few degrees, but may be as large as ten degrees. The angle at which the brake shoe assembly 22 is tilted changes slightly as the sash of a window is raised and lowered. As the sash of a window is raised and lowered, the orientation of the curl spring 24 relative to the brake shoe assembly 22 changes slightly. This results in different torque forces being applied to the brake shoe assembly 22. Thus, variations in the tilt of the brake shoe assembly 22 occur as a window sash is raised and lowered.

As the brake shoe assembly 22 tilts within the guide track 18, the curved side edges 30, 31 contact the side interior walls 47, 48 of the guide track 18. However, since the side edges 30, 31 have a convex curvature, the side interior walls 47, 48 of the guide track 18 contact the brake shoe housing 26 at a tangent. As the tilt orientation of the brake shoe assembly 22 changes, the tangential contact between the side interior walls 47, 48 of the guide track 18 and the brake shoe housing 26 remains consistent.

The tangential contact between the curved side edges 30, 31 of the brake shoe housing 26 and the side interior walls 47, 48 of the guide track 18 provide very little friction resistance to the movement of the brake shoe assembly 22 within the guide track 18. Furthermore, since the side edges 30, 31 of the brake shoe housing 26 blend into the curved top edge 28, there is no salient point on the brake shoe housing 26 that can wear into the side interior walls 47, 48 of the guide track 18 and bind the brake shoe assembly 22. The result is a brake shoe assembly 22 that is more reliable and is less likely to bind than traditional prior art devices.

In the embodiment of FIG. 3 and FIG. 4, the brake shoe assembly 22 is shown symmetrically formed around an imaginary centerline 32. This symmetrical orientation enables the brake shoe assembly 22 to be reversed without effect. Thus, a single brake shoe assembly 22 can be used in both the left side guide track and the right side guide track of a tilt-in window. Although this symmetrical configuration is preferred, it will be understood that asymmetrical brake shoe housings can be manufactured that can only be used on the right side or left side of a window frame. Such asymmetrical brake shoe assemblies need only have housings that are curved at the points of contact with the window guide tracks.

Figure 5:
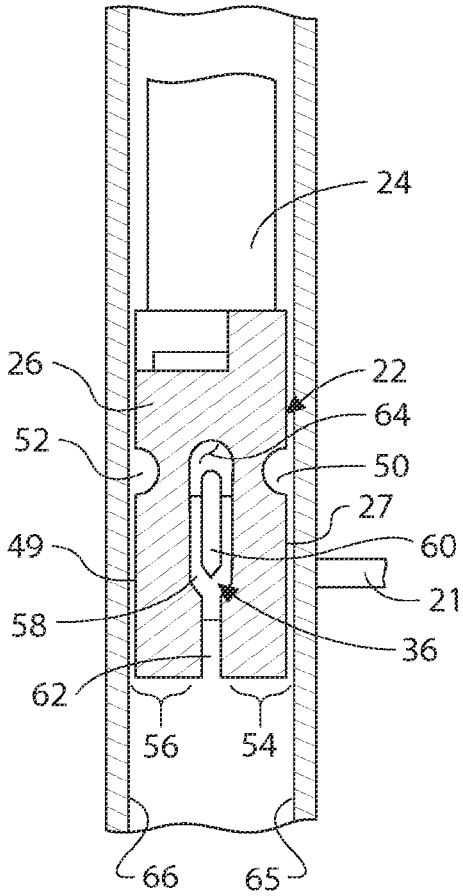
FIG. 5 is a cross-sectional view of the brake shoe assembly shown in a free position.

Referring to FIG. 5, it can be seen that the brake shoe housing 26 has a face surface 27 and a rear surface 49. A first lateral groove 50 is formed across the face surface 27 of the brake shoe housing 26. A parallel second lateral groove 52 is formed in the rear surface 49 of the brake shoe housing 26 at a corresponding position. Above the level of the first and second lateral grooves 50, 52, the brake shoe housing 26 is mostly solid. However, below the level of the first and second lateral grooves 50, 52, the brake shoe housing 26 is divided into a separate face section 54 and rear section 56.

The first and second lateral grooves 50, 52 thin the material of the brake shoe housing 26 in the face section 54 and the rear section 56. The first and second lateral grooves 50, 52 therefore create living hinges that allow the face section 54 and the rear section 56 of the brake shoe housing 26 to be selectively spread apart by the application of a spreading force.

In FIG. 5, it can be seen that the cam actuator 36 that extends through the brake shoe housing 26 contains a cylindrical body 58. On the exterior of the cylindrical body 58 is a cam arm 60. The cam arm 60 extends across no more than half the circumference of the cylindrical body 58.

Inside the brake shoe housing 26, the face section 54 of the housing 26 and the rear section 56 of the housing 26 are separated by a severance space 62. The severance space 62 is narrow below the level of the first and second lateral grooves 50, 52. However, just above the first and second lateral grooves 50, 52 there is an enlarged area 64.

When the sash of a window is in its functional, non-tilted position, the tilt-post 21 of the window orients the cam actuator 36 so that the cam arm 60 is positioned within the enlarged area 64 of the severance space 62. Such an orientation is shown in FIG. 5. When in such an orientation, the cam arm 60 does not act to spread the face section 54 of the housing 26 from the rear section 56 of the housing 26. Rather, the enlarged area 64 is slightly wider than the cam arm 60, thus the cam arm 60 has no effect on the brake shoe housing 26.

The distance between the face surface 27 of the brake shoe assembly 22 and the rear surface 49 of the brake shoe assembly 22 is smaller than the distance in between a forward wall 65 and a rearward wall 66 of the window frame guide track 18. The brake shoe assembly 22 is therefore free to move within the window frame guide track 18 uninhibited.

Figure 6:
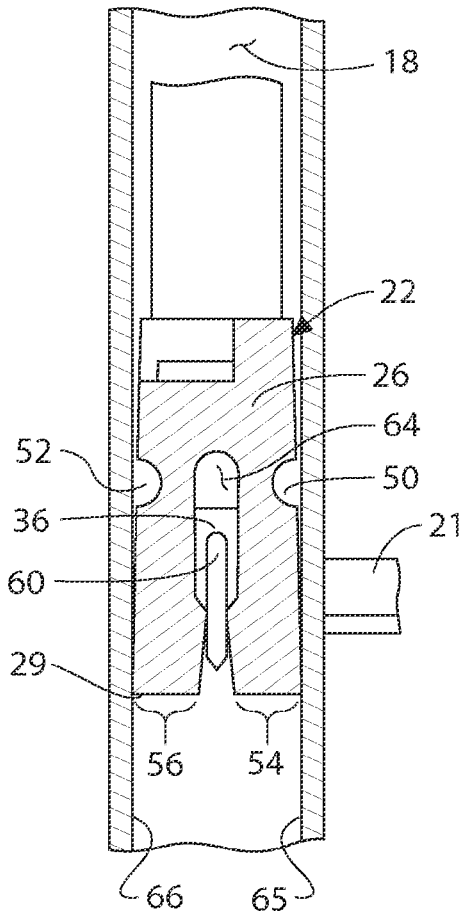
FIG. 6 is a cross-sectional view of the brake shoe assembly shown in a locked position.

Referring now to FIG. 6, it can be seen that the tilt-post 21 from the window has rotated. This rotation occurs when the sash of the window is tilted inwardly. As the tilt-post 21 rotates, the cam actuator 36 rotates. This causes the cam arm 60 to rotate out of the enlarged area 64 of the severance space 62. As the cam arm 60 rotates out of the enlarged area 64, the cam arm 60 passes in between the face section 54 and the rear section 56 of the brake shoe housing 26. This forces the face section 54 and the rear section 56 of the brake shoe housing 26 to spread apart.

The face section 54 and the rear section 56 hinge about the first and second lateral grooves 50, 52 as they spread. As such, the distance between the face surface 54 and the rear surface 56 increases and is at its maximum proximate the bottom edge 29. As the face section 54 and the rear section 56 spread, both sections 54, 56 contact, and are biased against, the forward wall 65 and rearward wall 66 of the window frame guide track 18. This causes the brake shoe assembly 22 to bind within the window frame guide track 18 and lock into place. It will therefore be understood that once a window sash is tilted and the cam actuator 36 is caused to turn, the brake shoe housing 26 spreads and the brake shoe assembly 22 locks in place within the window frame guide track 18.

Once the window sash is rotated back to its functional position, the cam arm 60 on the cam actuator 36 rotates back to the enlarged area 64 of the severance space 62. The bias force separating the face section 54 and the rear section 56 of the brake shoe housing 26 is removed. The face section 54 and the rear section 56 then converge back toward each other until the brake shoe assembly 22 is again free to move up and down within the confines of the window frame guide track 18.

Figure 7:
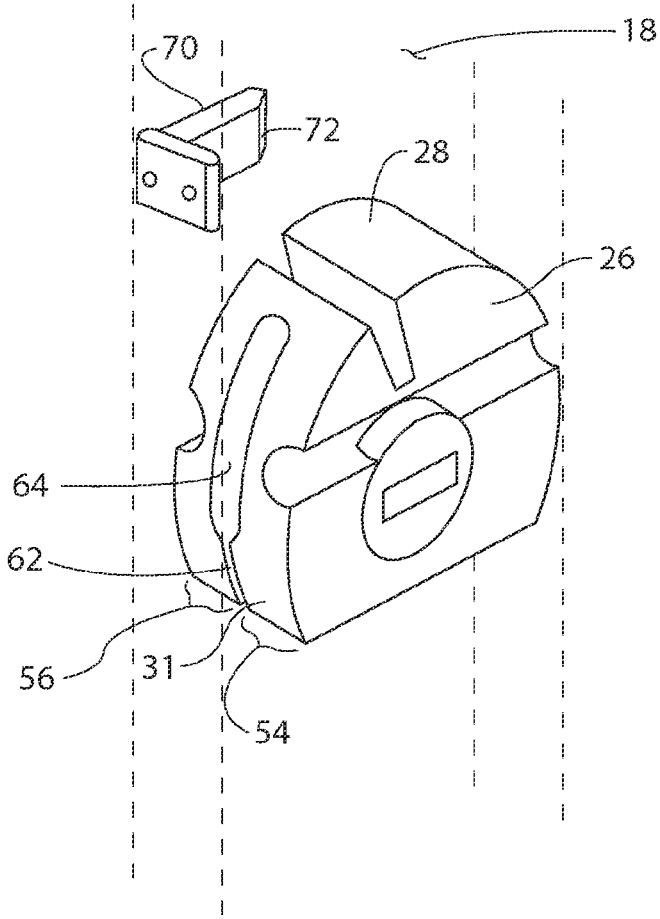
FIG. 7 is a perspective view of the brake shoe assembly engaging a locking wedge.

Referring to FIG. 7, it can be seen that the enlarged area 64 of the severance space 62 can be made to extend to both the side edge 31 and the top edge 28 of the brake shoe housing 26. A stopping wedge 70 can be anchored in a fixed position within the window frame guide track 18. The stopping wedge 70 has an elongated wedge element 72 that passes into the enlarged area 64 of the severance space 62 as the brake shoe assembly 22 moves toward the stopping wedge 70 in the window frame guide track 18. If the brake shoe assembly 22 further advances, once in contact with the stopping wedge 70, the wedge element 72 passes out below the enlarged area 64 of the severance space 62 and acts to spread the face section 54 and the rear section 56 of the brake shoe housing 26. This causes the brake shoe housing 26 to engage the window frame guide track 18 and lock in place. It will therefore be understood that by placing a stopping wedge 70 at the top of a window frame guide track 18, the brake shoe assembly 22 can be caused to lock in place when the window sash is fully open. This prevents the window sash from creeping closed once fully open.

It will be understood that the embodiment of the present invention counterbalance system that is described and illustrated herein is merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. A tilt-in window having a frame, a guide track in the frame, a window sash, a tilt post extending from the window sash into the guide track, and a counterbalance assembly for guiding movements of the tilt post in the guide track and counter balancing the window sash, said counterbalance assembly comprising:

a brake shoe housing positioned within the guide track, said brake shoe housing having a face section that faces the window sash and a rear section that faces away from the window sash, said face section and said rear section being disposed between a first side edge of said housing, a second side edge of said housing, a top edge of said housing, and a bottom edge of said housing, wherein said face section and said rear section are separated by a predetermined distance proximate said bottom edge of said shoe housing and are joined together proximate said top edge of said brake shoe housing, and wherein said first side edge of said shoe housing is a curved surface having a convex curvature;

a receptacle disposed within said face section for receiving the tilt post therein; and a curl spring having a free end, wherein said curl spring is anchored in the guide track above said brake shoe housing;

wherein said free end of said curl spring engages said brake shoe housing at an eccentric position on said housing, thus said curl spring applies a turning torque to said brake shoe housing that cocks said brake shoe housing in the guide track and physically biases said first side edge into tangential contact with said guide track without moving said tilt post; and a brake mechanism that biases said face section and said rear section apart when the window sash is tilted relative to said frame, therein increasing said predetermined distance between said face section and said rear section and locking said brake shoe housing in a fixed position within the guide track.

2. The window according to claim 1, wherein said second side edge has a convex curvature and said curl spring biases said second side edge into tangential contact with the guide track.

3. The window according to claim 2, wherein both said first side edge and said second side edge have an equal radius of curvature in at least one section thereof.

4. The window according to claim 1, wherein said brake mechanism includes a cam disposed between said face section and said rear section, wherein said cam biases said face section and said rear section apart when rotated relative to said housing.

5. The window according to claim 1, further including a spring mount slot extending through said top edge of said brake shoe housing, wherein said free end of said curl spring is received within said spring mount slot.

6. The window according to claim 5, further including a locking pin hole that intersects said spring mount slot and a locking pin that is sized to extend through said locking pin hole.

7. A counterbalance assembly for counterbalancing a tilt-in window sash, said counterbalance assembly comprising:

a brake shoe housing having a face section and a rear section both defined between a top edge of said housing, a bottom edge of said housing, and two side edges of said housing, wherein at least one of said two side edges of said brake shoe housing is a curved surface having a convex curvature;

a curl spring having a free end, wherein said free end of said curl spring engages said brake shoe housing at an eccentric position on said housing, thus said curl spring applies turning torque to said brake shoe housing that cocks said brake shoe housing in a guide track and biases said curved surface into tangential contact with said guide track without tilting said tilt-in window sash; and a cam actuator interposed between said face section and said rear section that spreads said face section and said rear section apart and into contact with said guide track when said cam actuator is rotated into a first position relative said shoe housing.

8. The assembly according to claim 7, wherein said top edge has a convex curvature.

9. The assembly according to claim 7, wherein said face section and said rear section are separated proximate said bottom edge and joined together proximate said top edge.

10. A tilt-in window assembly, comprising:

a window frame having guide tracks, wherein each of said guide tracks has interior side walls;

window sashes having tilt posts that extend outwardly from said sashes, wherein each of said sashes can be selectively tilted about a respective pair of said tilt posts between an operational orientation and a tilted orientation;

brake shoes disposed within said guide tracks between said interior side walls, wherein said brake shoes receive said tilt posts and guide said tilt posts within said guide tracks, and wherein each of said brake shoes has a housing with curved side edges, wherein said housing of each of said brake shoes has a face surface and a rear surface disposed between said curved side edges that expand apart when said sashes are tilted from said operational orientations to said tilted orientations; and curl springs mounted in said guide tracks above said brake shoes, each of said curl springs having a free end that is joined to a respective one of said brake shoe housings at an eccentric position on said housing, thus said curl springs apply turning torques to said brake shoes that cock said brake shoes in said guide tracks and bias said curved side edges into tangential contact with said interior side walls within said guide tracks without moving said tilt posts.

11. The assembly according to claim 10, wherein each of said brake shoe housings has a top edge that has a convex curvature.

* * * * *